US010314443B2

(12) United States Patent
Roeder

(10) Patent No.: US 10,314,443 B2
(45) Date of Patent: Jun. 11, 2019

(54) FREE-STANDING, MULTIPLE ROLL TOILET PAPER HOLDER AND DISPENSER

(71) Applicant: Jennifer S. Roeder, Woodstock, GA (US)

(72) Inventor: Jennifer S. Roeder, Woodstock, GA (US)

( * ) Notice: Subject to any disclaimer, the term of this patent is extended or adjusted under 35 U.S.C. 154(b) by 82 days.

(21) Appl. No.: 15/530,395

(22) Filed: Jan. 9, 2017

(65) Prior Publication Data

US 2018/0192833 A1 Jul. 12, 2018

(51) Int. Cl.

*A47K 10/22* (2006.01)
*A47K 10/32* (2006.01)
*A47K 10/38* (2006.01)

(52) U.S. Cl.

CPC ..... *A47K 10/3827* (2013.01); *A47K 10/22* (2013.01); *A47K 10/38* (2013.01); *A47K 10/3818* (2013.01); *A47K 2010/3206* (2013.01); *A47K 2010/3253* (2013.01)

(58) Field of Classification Search

USPC ..... 242/55.42, 551, 593
See application file for complete search history.

(56) References Cited

U.S. PATENT DOCUMENTS 3,316,040 A * 4/1967 McGann ..... A47K 10/22 248/220.1
4,022,396 A * 5/1977 Manchester ..... B65H 49/12 242/129
4,177,958 A * 12/1979 Poole ..... A47K 10/3836 242/560
4,463,912 A * 8/1984 Grunerud ..... A47K 10/3836 242/560.2
4,765,475 A * 8/1988 Kaysserian ..... A47K 10/3836 206/390
5,205,455 A * 4/1993 Moody ..... A47K 10/3818 206/409
5,219,126 A * 6/1993 Schutz ..... A47K 10/3818 206/390
5,857,621 A * 1/1999 Poulos ..... A47K 10/22 215/236
6,422,503 B1 * 7/2002 Hoo Kong ..... A47K 10/22 242/559.4
2003/0122008 A1 * 7/2003 Abba ..... B65H 18/28 242/160.2

(Continued)

*Primary Examiner* — Michael R Mansen
*Assistant Examiner* — Mark K Buse
(74) *Attorney, Agent, or Firm* — Harry I. Leon; Vivian L. Stendman

(57) ABSTRACT

A free-standing, cylindrical container and multiple, core-free toilet paper rolls vertically stacked in an array which fills the container at the outset of its use. Peeled back from sites bounding a through opening within the array's uppermost roll and then fed through a narrow slot defined by the container's cap, each length of the paper so fed, prior to its being separated from paper yet to be dispensed, is part of a continuous paper ribbon extending from the leading paper sheet of said length to the outermost sheet of the array's lowermost roll. Configuring the ribbon in its initial state is a series of joints in each of which the outermost and the innermost sheets of the upper and lower rolls, respectively, of one of the array's contiguous pairs of rolls are fixedly connected, thus providing the user with immediate access to the entire body of paper stored within the container.

3 Claims, 3 Drawing Sheets

(56) References Cited

U.S. PATENT DOCUMENTS

| | | | | |
|---|---|---|---|---|
| 2003/0122028 | A1* | 7/2003 | Abba | B65H 49/34<br>242/566 |
| 2004/0188297 | A1* | 9/2004 | Daniels | A47K 10/22<br>206/394 |
| 2006/0180698 | A1* | 8/2006 | Hensley | A47K 10/22<br>242/560 |
| 2010/0001015 | A1* | 1/2010 | Thoren | A47K 10/3818<br>221/30 |

* cited by examiner

FREE-STANDING, MULTIPLE ROLL TOILET PAPER HOLDER AND DISPENSER

BACKGROUND OF THE INVENTION

Toilet paper is commonly used for personal hygiene in homes and businesses wherever a toilet is available. However, in the event the paper is used up and additional supplies of it are not readily available close at hand, a user may experience a slight panic attack. Known toilet paper dispensers for remedying this problem entail supporting two or more rolls of the paper either vertically or side-by-side with the rolls rotatable about an axis that is an essential component of the dispenser supporting them. Unfortunately, wells, in the form of hemicylindrically-shaped wall cavities, which are long enough to accommodate two rolls so supported do not exist in most houses.

SUMMARY OF THE INVENTION

The object of the present invention is to provide a free-standing device which not only gives the user immediate access to sheets of paper stored in more than one roll of toilet paper, but also eliminates the need for a holder having either a horizontal or a vertical axis for rotatably supporting such rolls.

A further object is to provide such a device which frees the attendant/caretaker from having to waste time and limited bathroom or restroom storage space in housing multiple rolls of toilet paper close at hand ready for use.

In accordance with the present invention, there is provided a toilet paper assembly which comprises a hollow, elongated tube whose upper and lower ends are capped and sealed, respectively, and when the tube is filled to its limit in preparation for use, a vertically stacked array of multiple rolls of toilet paper perforated transversely to each roll's longitudinal centerline so as to form interconnected paper sheets, each roll, in its generally wound state, being slideably received within the tube, wherein the array, prior to an unwinding of the two uppermost rolls so vertically stacked, includes at least one contiguous pair of rolls in which not only does an upper roll in the pair define a core-free, through opening which extends between the upper roll's opposing ends but also the upper roll's outermost paper sheet is fixedly connected to the innermost paper sheet of the pair's lower roll, and wherein the assembly further comprises means, including a narrow slot defined by a cap disposed at the tube's upper end, for retaining at least a portion of a paper sheet atop the cap immediately following each time a user selectively withdraws paper by pulling it through the slot until substantially all of the paper has been dispensed, each portion of a paper sheet so retained being interconnected with those sheets remaining within the tube, so that in general, all of them can be fed into and through its slot.

In a preferred embodiment, a leader is fixedly attached to the innermost sheet of the roll which, when the tube is so filled to its limit, is disposed in closest proximity to the slot, the leader being inserted into the slot to facilitate a user's pulling the innermost sheet to which the leader is so attached or one of the sheets disposed immediately behind it on the same roll, in readiness for the assembly's use.

DESCRIPTION OF THE PREFERRED EMBODIMENTS

Figure 1:
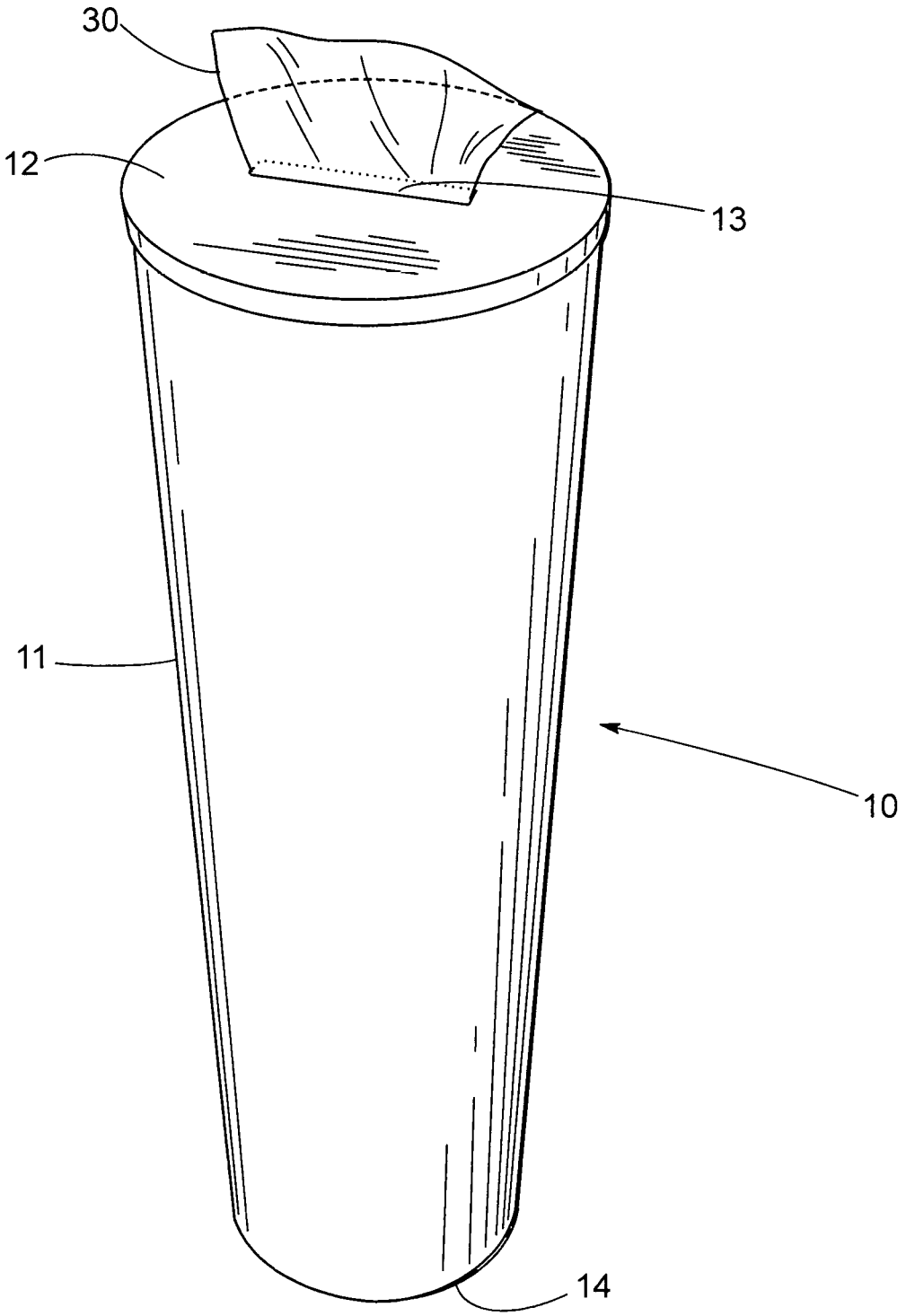
FIG. 1 is a top perspective view of the toilet paper assembly according to the present invention, in which is shown the assembly's tube and slotted cap covering the tube's upper end as well as a piece of toilet paper, supported by the slot and protruding upwardly from it.

In the drawings, a preferred embodiment of the toilet paper assembly according to the present invention is indicated generally by the reference numeral 10. The assembly 10 includes a free-standing container and a vertically stacked array of core-free toilet paper rolls 20,21,22,23 slideably received within the container's hollow, cylindrical tube 11 which rests on a base 14 to which the tube's lower end is affixed. Removably mounted atop the container at the tube's upper end is a slotted cap 12 which, in use, is threadedly engaged with, or otherwise securely fitted onto or into, said end.

Slot 13, defined by cap 12, is dimensioned so as not only to facilitate the selective withdrawal of toilet paper sheets by pulling the paper through the slot, but also to provide for the retention of at least a portion of a paper sheet atop the cap immediately following each such withdrawal until substantially all of the paper within said array has been dispensed. Preferably, the slot's width is about inch and its length at least one half of the transverse width of the paper in each of the rolls.

Sized to store multiple rolls of commercially available toilet paper, each of which has the same outside diameter as well as the same width of paper measured transversely to the paper's longitudinal centerline, the tube's inside diameter and height are approximately equal to the roll's outside diameter and to a multiple of the paper's transverse width, respectively, with the multiple being the number of rolls preloaded into the tube 11 when the latter is filled to its limit. Specifically, for a tube with the capacity to store up to four standard toilet paper rolls, each measuring about 5 inches in outside diameter and formed of paper, wound upon itself, in which each sheet of the paper is approximately 4 inches in transverse width, the tube's inside diameter and height are, respectively, about 5 inches and 16 inches. In order to provide greater storage capacity, the tube's height may be increased as follows: 20 inches for a five roll container, 24 inches for a six roll container, and so forth.

Figure 2:
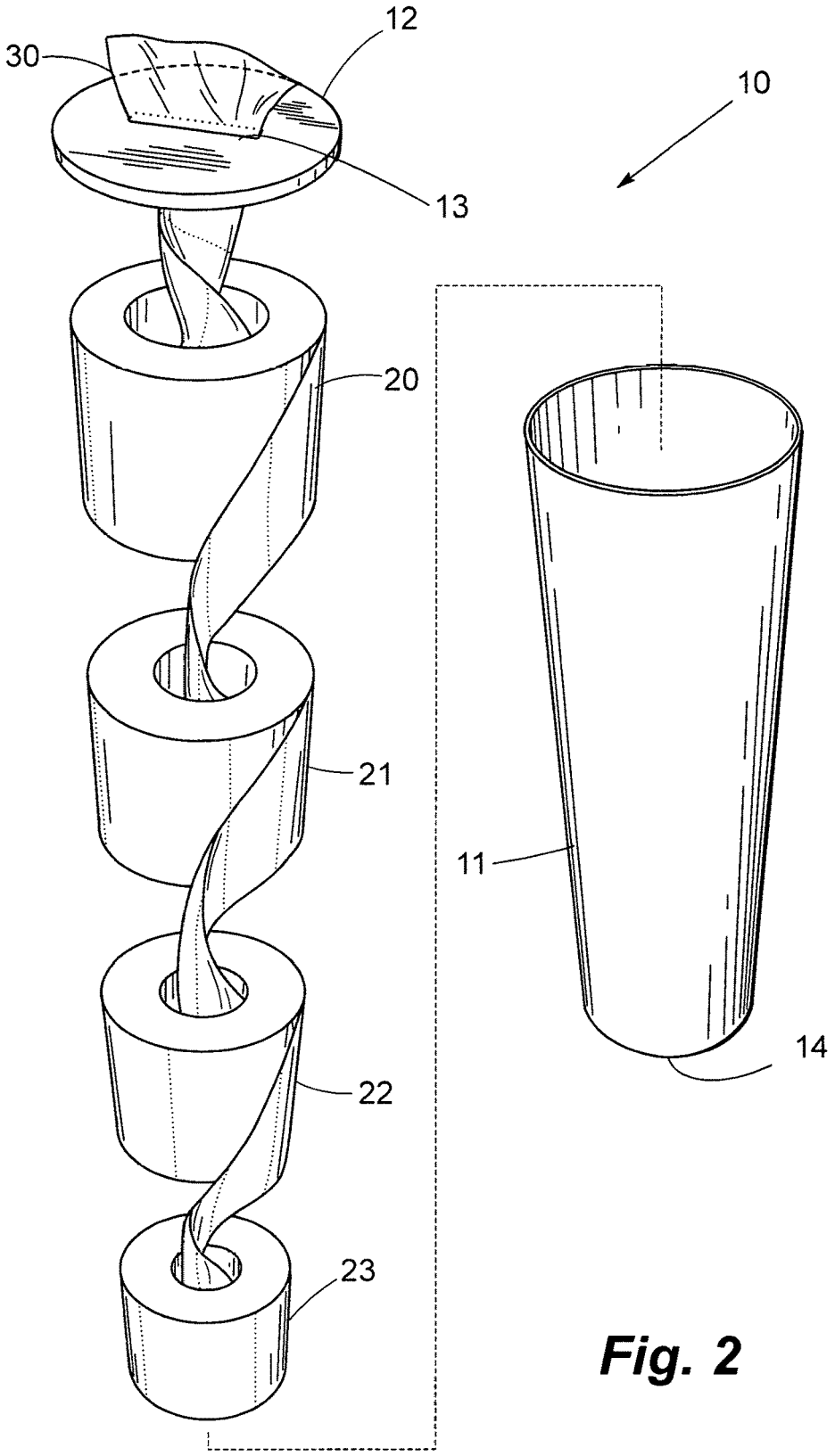
FIG. 2 is an exploded view of the assembly showing the tube in cross-section and preloaded with multiple rolls of paper in which each contiguous pair of these rolls has its upper roll's outermost paper sheet fixedly connected to the innermost paper sheet of the pair's lower roll.
Figure 3:
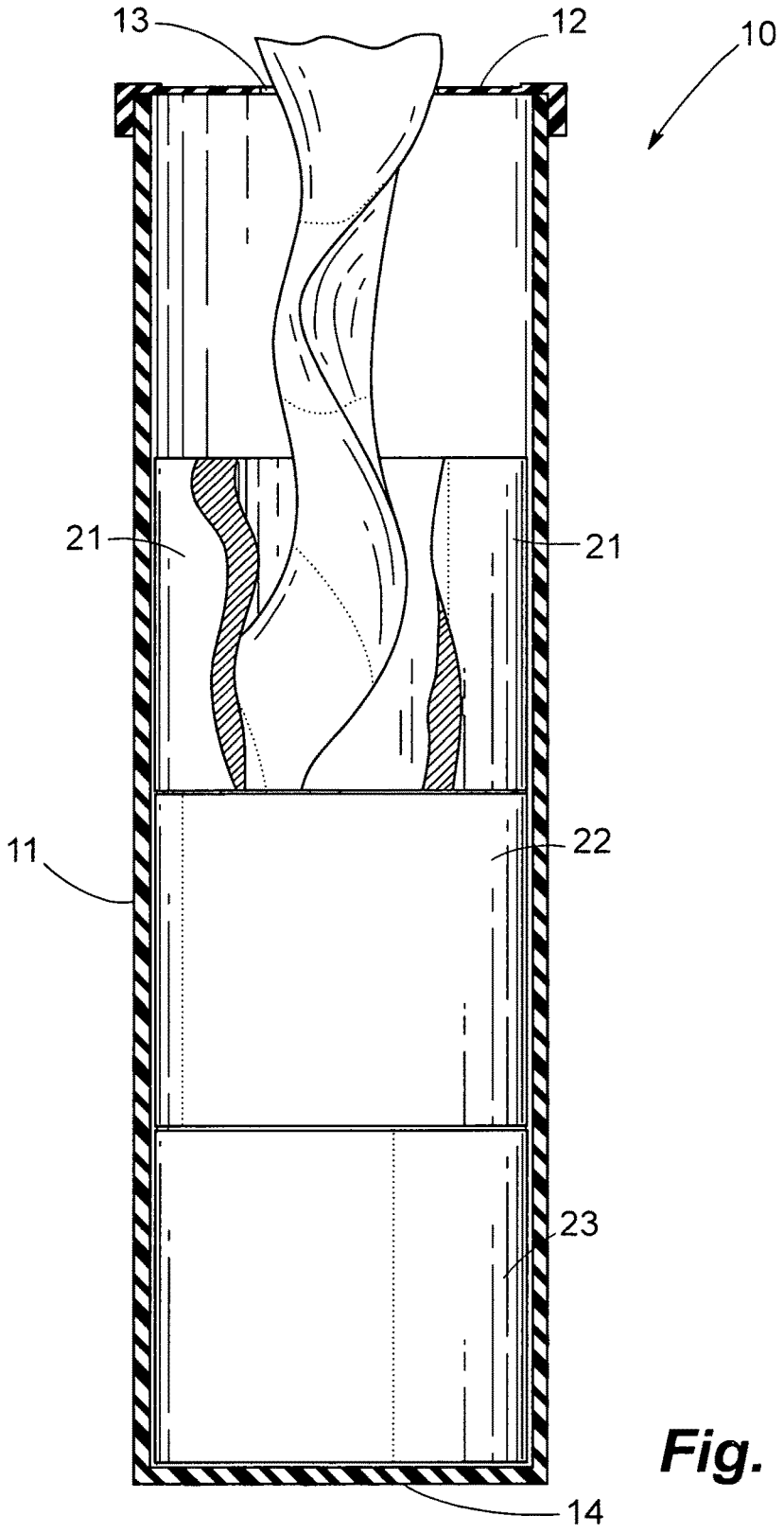
FIG. 3 depicts the tube and its cap in cross-section and a cutaway of the uppermost roll when it has been partially unwound and less than a full complement of the rolls preloaded within the tube remains in it but paper can still be withdrawn from the tube by pulling it into and through the slot, the view further illustrating an overlap between portions of the uppermost roll's innermost paper sheet as it is peeled back on itself enroute to the slot.

As is illustrated in FIG. 2, the rolls 20,21,22,23, preloaded into the container's tube 11 in preparation for use, are interconnected so as to form a continuous ribbon of toilet paper which extends from the leading paper sheet 30 of the array's uppermost roll 20 to the outermost paper sheet of the array's lowermost roll 23. Throughout this continuous ribbon, each pair of rolls which are disposed contiguously—that is, with one resting on top of the other—in the assembly 10 has had, in the course of the array's construction, at least one paper end of each of the pair's rolls unwound to the extent that the outermost paper sheet of the pair's upper roll can be fixedly connected to the innermost paper sheet of the pair's lower roll. In the assembly 10 itself then, one finds a repeating pattern applied to each of the contiguous pairs of rolls 20,21; 21,22; 22,23, beginning with the last sheet 31 of roll 20 connected to the first sheet 32 of roll 21, and the last sheet of roll 21 connected to the first sheet of roll 22 (FIG. 2).

A recommended toilet paper sold currently is Scott Core Free® in which each roll's paper is wound so as to define a through opening which, because the tube lacks a cardboard tube or the like, provides easy access to the roll's innermost paper sheet, thus facilitating its withdrawal so that it can be connected to another roll's outermost paper sheet as the array is being assembled. Other brands may be used; but before the array is constructed, any cardboard tube or the like lining a roll's through opening needs to be removed.

The connection between the last paper sheet of a contiguous pair's lower roll and the first paper sheet of the pair's upper roll can be formed by using a suitable glue, taping or otherwise tying said sheets together so as to form a joint between the rolls' ends which can be readily pulled through the slot 13. Importantly, both upstream and downstream of the connection between said first and last paper sheets, the outer face of the paper in both of the pair's rolls continues to face outwardly, thus aligning the conjoined rolls so that the paper which remains wound on each of them is wound in the same direction—either clockwise or counterclockwise with respect to the longitudinal centerline of their respective through openings (FIG. 2).

During use, the orientation of each of the array's paper sheets which in turn becomes the innermost sheet of the uppermost roll—that is, said innermost sheet's orientation with respect to the sheets immediately following it—is set once a installer peels back the sheet 30 on itself and then inserts it into the slot 13. The pattern thus set, in combination with the space constraints imposed upon each roll yet to be used by the tube's inner wall, as well as by frictional forces acting at the interfaces between each contiguous pair of rolls and between the lowermost roll 23 and the base 14 as it rests thereon. In addition, the use of rolls which offer a significant degree of resistance to the peeling process keeps the paper from unraveling on its own, thus virtually eliminating the potential for tanglable slack to be created along the length of paper extending from whichever roll is then uppermost in the tube 11 to the slot 13, even when a user forcefully withdraws paper from the assembly 10. In such preferred rolls, including Scott Core Free® toilet paper, contiguous sheets within a roll's overlapping paper layers exhibit a marked tendency to adhere to each other.

The base 14, preferably sealed to the lower end of the tube 11, forms afoot designed to rest on a floor surface of a bathroom or restroom, so that the free-standing assembly 10 can be maintained in an upright position next to a toilet. A weight (not shown) housed within the lower end of the tube 11 or, alternately, attached to the base 14 or formed integrally therewith may also be provided to further stabilize the assembly 10.

Both the container and its cap 12 are preferably fabricated of a water resistant material such as a plastic, and they may be covered externally with a decorative design suitable for use in the bathroom or storage on a shelf there, as well as for commercial display purposes. Further, the texture of the container's surfaces may be designed to enhance frictional forces acting at interfaces between the tube's inner wall and the rolls 20,21,22,23 and between roll 23 and the base 14. The container and its cap 12 may also serve as packaging for shipping the assembly 10.

It is claimed:

1. A toilet paper assembly which is free-standing, comprising:

a hollow, elongated cylindrical tube with a closed, flat bottom, an array of multiple rolls of core-free toilet paper which are stored in a vertical stack within the tube, each of the array's rolls, while still in its generally wound state, being slideably received within the tube, with the tube defining an interior, cylindrically shaped surface lengthwise of which each roll can be slideably moved as it is being so slideably received, and a cap which is removably attached to the tube at its upper end, said cap defining a narrow, elongated, closed ended slot through which paper is pulled, in the process of unwinding the array's paper each time a user selectively withdraws at least one of its sheets from the tube; wherein each roll defines an outermost convolution, as well as an innermost convolution, of the paper wound on said roll; and wherein the array, prior to an unwinding of the two uppermost rolls so vertically stacked, includes at least one contiguous pair of rolls in which the upper roll's outermost convolution is fixedly connected to the innermost convolution of the pair's lower roll.

2. The toilet paper assembly according to claim 1, wherein the narrow, elongated, closed ended slot is further characterized as measuring about ½ inch in width and having a length that is at least one half of the transverse width of the paper in each of said rolls, with the slot so shaped and dimensioned retaining at least a portion of a paper sheet atop the cap immediately following each use a high percentage of the time a person selectively withdraws paper by pulling it through the slot until substantially all of the paper has been dispensed, provided each portion of a paper sheet so retained is interconnected with those sheets remaining within the tube.

3. The toilet paper assembly according to claim 1, wherein all of the contiguous pairs of rolls in said array of multiple rolls have the outermost convolution of the pair's upper roll fixedly connected to the innermost convolution of the pair's lower roll, so that all of the rolls, once the cap has been removed from the tube's upper end, can be slideably received within the tube as a single unit; and wherein the number of contiguous pairs of rolls in said array is at least two.

* * * * *